US007617711B2

(12) United States Patent
Palzer et al.

(10) Patent No.: US 7,617,711 B2
(45) Date of Patent: Nov. 17, 2009

(54) METHOD OF CONTROLLING THE CROSS SECTION OF A WIRE ROD STRAND EMERGING FROM A WIRE ROD MILL LINE

(75) Inventors: Ottmar Palzer, Moenchengladbach (DE); Lutz Kuemmel, Juechen (DE); Matthias Burkhardt, Duisburg (DE)

(73) Assignee: SMS Meer GmbH, Mochengladbach (DE)

( * ) Notice: Subject to any disclaimer, the term of this patent is extended or adjusted under 35 U.S.C. 154(b) by 347 days.

(21) Appl. No.: 11/292,339

(22) Filed: Dec. 1, 2005

(65) Prior Publication Data

US 2006/0150701 A1 Jul. 13, 2006

(30) Foreign Application Priority Data

Dec. 7, 2004 (DE) ..... 10 2004 058 825
Aug. 2, 2005 (DE) ..... 10 2005 036 184

(51) Int. Cl.
*B21B 39/08* (2006.01)
*B21B 39/00* (2006.01)
*B21B 37/68* (2006.01)

(52) U.S. Cl. ..... 72/205; 72/12.7; 72/226

(58) Field of Classification Search ..... 72/8.3, 72/8.6, 8.9, 11.1, 11.4, 11.6, 12.2, 12.7, 205, 72/365.2, 8.5, 16.5, 18.3, 224–226, 234; 700/108, 109, 148, 150, 152, 153
See application file for complete search history.

(56) References Cited

U.S. PATENT DOCUMENTS 3,540,248 A * 11/1970 Hostetter et al. ..... 72/8.5
3,766,763 A * 10/1973 Cofer et al. ..... 72/12.2
4,141,071 A * 2/1979 Yerkes et al. ..... 700/152
4,607,511 A * 8/1986 Shore ..... 72/12.7
4,662,202 A * 5/1987 Lambert ..... 72/8.5
4,665,730 A * 5/1987 Maroti ..... 72/205
4,674,310 A * 6/1987 Ginzburg ..... 72/11.4
5,794,473 A * 8/1998 Palzer ..... 72/8.9
6,055,834 A * 5/2000 Vedova et al. ..... 72/8.9
6,112,566 A * 9/2000 Palzer et al. ..... 72/10.7
6,199,417 B1 * 3/2001 Palzer et al. ..... 72/8.6
6,519,990 B1 * 2/2003 Olsson et al. ..... 72/12.7

* cited by examiner

*Primary Examiner*—Dana Ross
*Assistant Examiner*—Teresa M Bonk
(74) *Attorney, Agent, or Firm*—Andrew Wilford

(57) ABSTRACT

In a wire rod mill, the last rolling block or unit, either a finishing unit or a postfinishing rolling unit, with common drive is not used for traction control, but traction control upstream thereof is provided to regulate the cross section of the wire rod strand before entry into the last stage. The product is a wire rod strand of low cross sectional tolerance and high uniformity over the length of the rod.

7 Claims, 5 Drawing Sheets

AQR
RE
PZR/PZM
$A_2^*$
$T_2$
$A_2$
$T_1$
$T_0$
$F_S^*$
$F_S$
$h_R$
$h_R^*$
$n_2^*$
$n_1^*$
$\pm\Delta n$
1
2
3
4
5
6
7
8
9
10
11
14
15
16
$A_2$
$T_0, T_1, T_2$
$h_R$
$F_S$
$\Delta n$
*
7
8
9
10
11
14,15,16

METHOD OF CONTROLLING THE CROSS SECTION OF A WIRE ROD STRAND EMERGING FROM A WIRE ROD MILL LINE

FIELD OF THE INVENTION

Our present invention relates to a method of controlling the cross section of a rolled wire rod strand emerging from a wire rod mill line and to a wire rod mill line in which the cross section of the rolled wire rod strand emerging therefrom is controlled.

More particularly the invention relates to a method and a wire rod mill line of the type in which a rolled wire rod strand passes from an intermediate portion of the rolling line to a finish rolling unit comprised of one or more mill stands and which may be followed, optionally but not necessarily, by a post rolling unit or after-rolling unit comprised also of one or more mill stands whereby the cross section of the wire rod strand during the rolling process can be altered by controlled application of traction to the strand.

BACKGROUND OF THE INVENTION

Modern wire rod rolling lines are required to have significantly narrower tolerances with respect to the cross section of the rolled wire rod strand emerging from that line than can be obtained by manual correction of the parameters of the rolling mill line using classical wire rod rolling techniques. Not only must the cross sectional tolerances be significantly narrower, but deviations from the set point cross section must be held to a minimum over the entire length of the rolled wire rod. The tolerances of the wire rod following the finish rolling unit are determined by a number of parameters. Perhaps the greatest influence on the cross sectional tolerances is the cross section of the rolled wire rod strand entering the finishing unit or the group of mill stands forming the finishing unit and the entry temperature of the strand. Cross sectional variations and temperature variations of the strand entering the finishing unit in the past have been found to result in traction or tension fluctuations as the strand passes through the finishing unit and these fluctuations in turn give rise to substantial tolerance variations or fluctuations in the strand emerging from the finishing unit.

The entry cross section of the strand at the finishing unit depends, in turn, upon the traction applied in the preceding intermediate line or in any preceding mill stand or group of mill stands, among other parameters. The rolling conditions generally do not remain constant during the rolling of the rod but continuously tend to vary during the rolling process. These rolling conditions include not only the entry cross section parameter but parameters like temperature, longitudinal tension and others which contribute to cross sectional variations.

In order to achieve good tolerances, i.e. narrow tolerances, in spite of these continuously varying rolling conditions, the settings of any rolling units which contribute to the rolling conditions must be matched or adjusted closely. This is, however, extremely difficult in practice since with standard group drive of the rolls of the rolling unit, for example, the finishing unit, only the roll gaps can be adjusted and the drive speeds cannot be corrected. With previously known systems, considerable effort has been expended in attempts to eliminate the negative effects described above on the fabrication tolerances with the goal of obtaining a constant outlet cross section of the wire rod from the finishing rolling unit and to control, in spite of the aforementioned difficulties, the entry cross section of the wire rod strand into the finishing unit in a reliable manner.

Thus EP 200 396 B1 describes a system in which upstream of the finishing unit in the rolling direction, two sizing mill stands which are provided one after another and whose speeds are so controllable that with these stands a traction is applied which contributes a corresponding reduction in the wire rod cross section and makes it possible to feed the wire rod into the finishing unit with a relatively uniform cross section.

OBJECT OF THE INVENTION

It is the principal object of the present invention to provide an improved method of controlling the cross section of a rolled wire rod strand emerging from a wire rod mill line, especially to reduce the variation tolerances in that cross section and to maintain uniformity of that cross section over the length of the roller wire rod.

It is another object of the invention to provide an improved method of controlling the cross section of a rolled wire rod strand and an improved wire rod mill line in which that control process can be used and which allows, in a simple manner, matching the wire rod production to the varying rolling conditions and enabling, independently of the latter, an optimum finished cross section of the wire or rod to be obtained.

Still another object of this invention is to eliminate the drawbacks of prior art systems in the rolling of wire rod.

SUMMARY OF THE INVENTION

These objects and others which will become apparent herein after are attained, in accordance with the invention, in a method of controlling the cross section of a rolled wire rod strand emerging from a wire rod mill line and whereby the wire rod strand passes from an intermediate rolling line into a finish rolling unit forming a common drive group with at least one finishing mill stand, the finishing mill can be followed by an optional post rolling unit or after-rolling or post-finishing unit forming a common drive group with at least one post-finishing rolling mill stand, and the cross section of the wire rod strand is altered during the rolling by controlled application of traction to the strand. The method comprises the steps of:

(a) applying the traction for cross section alteration to the strand upstream of the last common drive group; and (b) regulating the applied traction so that the wire rod strand emerging from the last common drive group is of constant uniform cross section.

The finishing rolling unit and any post rolling unit are referred to herein also as common drive groups since generally the speeds of rolling mill stands in each of these units are not varied individually, at least with respect to the stands of the particular unit, but rather any adjustment is to the rolling gap. In the case in which the last common drive group is a post rolling unit, the application of traction can be made upstream or downstream of the finish rolling unit whereas, in the case in which the last common drive group is the finish rolling unit, the traction is supplied upstream thereof.

According to the invention, therefore, the last common drive group can be and preferably is the finish rolling unit.

The traction is preferably applied by a pair of controllable speed horizontal-roll and vertical-roll mill stands Preferably, a tensioning roll with a displacement sensor is pressed into the wire rod strand to generate a set point deflection therein corresponding to a predetermined ratio of due force to tractive force in the strand. The adjustment of the tractive force to a reference value of the tractive force on the strand is effected by controlling the speed of at least one of the horizontal-roll and vertical-roll mill stands.

With respect to the apparatus features of the invention, a wire rod mill for rolling a wire rod strand can comprise:

a series of mill stands for rolling a wire rod strand and including an intermediate rolling line;

a finish rolling unit downstream of said intermediate rolling line and forming a common drive group with at least one finishing mill stand;

an optional post rolling unit forming a common drive group with at least one post rolling mill stand; and a unit for altering the cross section of the wire rod strand during the rolling by controlled application of traction to the strand by applying the traction for cross section alteration to the strand upstream of the last common drive group and regulating the applied traction so that the wire rod strand emerging from the last common drive group is of constant uniform cross section.

The apparatus likewise can comprise a horizontal-roll stand and a vertical-roll stand engaging a wire rod strand and imparting traction to said strand, and a traction control unit for regulating the traction applied to said strand by said stands and including pyrometers upstream and downstream of said stands for measuring temperature of said strand.

The invention is based upon the fact that it is possible, by contrast with conventional wire rod mill configurations to obtain a uniform and close-tolerance exit cross section from the finish rolling unit (when that is the last common drive group) or from the post rolling unit (where that is the last common drive unit) based upon a variation in the inlet cross section of the wire rod strand to the respective unit. As a consequence, the tractive control of the wire rod strand of the cross section can thus be provided at optional locations prior to this last common drive group or unit and were necessary immediately upstream of the last drive unit or group, i.e. the last unit in the rolling process and without regulating the speed of the common drive group of that unit at all.

According to the invention, this is achieved by measuring and comparing the wire rod cross section preferably upstream and downstream of the finish rolling unit and altering the inlet cross section of the wire rod strand by applying the appropriate tractive force thereto. This traction force for controlling the entry cross section can be developed upstream of the finish rolling unit by a pair of controllable-speed horizontal-roll and vertical-roll frames or stands arranged along the path of the wire rod strand and upstream of the finishing unit.

According to a feature of the invention, between these two stands or frames, a piston-and-cylinder unit can be provided which has a piston with a controllable displacement as signaled by a displacement sensor and which carries a tensioning roll bearing upon the wire rod strand and imparting a deflection thereto. In addition, upstream and downstream of the horizontal-roll and vertical-roll pair and downstream of the finishing unit or the post rolling unit, profile measuring devices and in association there-with or independently therefrom, upstream of these stands and upstream of the finishing unit or the post rolling unit pyrometers can be provided.

The reference to profile measurement herein is intended to identify a measurement of the cross section and cross sectional shape of the strand capable of determining deviations from tensional and shape tolerances.

When upstream of the stands, both a profile measurement system and a temperature measurement system are provided, the cross section $A_0$ and the temperature $T_0$ can be measured. For a given type of steel and temperature $T_0$, as will be described in greater detail hereinafter with respect to FIG. 3, by a correlation between $A_0$ and $A_1$, a forward control can be developed which enables a new charge to be produced in the permissible tolerance range from the first.

Direct control in this manner does not require feedback.

The invention also enables adaptive cross sectional control using a hierarchical sizing system and a continuous adaptation of the single pass cross section independently of continuously altering rolling conditions, ensuring at each point in time the best possible finish cross section with a minimal tolerance fluctuation. The adaptive cross sectional control requires that all subordinated control or regulating procedures or measurements be activated including the position-tension measurements, position-tension control and position-cross section control.

In backward control or regulation as will be described in greater detail in connection with FIG. 4, downstream of the stands, a profile measuring device is required. It uses the width of the rolled product downstream of the rolling mill stands as a control parameter for the cross section control of these stands. The cross section A1 is thus varied in accordance with a variable traction $F_z(t)$ between the two stands producing the traction to yield the function $A_1(t)$ providing an optimum downstream cross section and a constant width in the section $A_2$ and optimum quality of the ovalness of the rolled product.

If a rapid backward control is to be achieved as will be described in greater detail in connection with FIG. 5, in addition upstream of the first stand of the traction pair of stands a profile measuring device or system should be provided. For product to product adaptation with the same types of steel and temperatures $T_1$ and $T_2$ in the wire rod line and be correlations between the cross sections between the cross sections $A_1$ and $A_2$ and adaptation values, a shift in the control points can be obtained. The cross section control is then carried out highly dynamically and fluctuations in the cross section and the oval character can be minimized.

If adaptation with slow backward control is carried out, it is thereby intended to only eliminate system errors and trends.

Finally, it is also possible to carry out some kind of control in the finish unit so that the cross section is effected in a controlled manner before the strand emerges and in that case the finish unit can have a sequence of rolling stands to apply traction and which may then have adjustable-gap rolls or controllable speed rolls.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
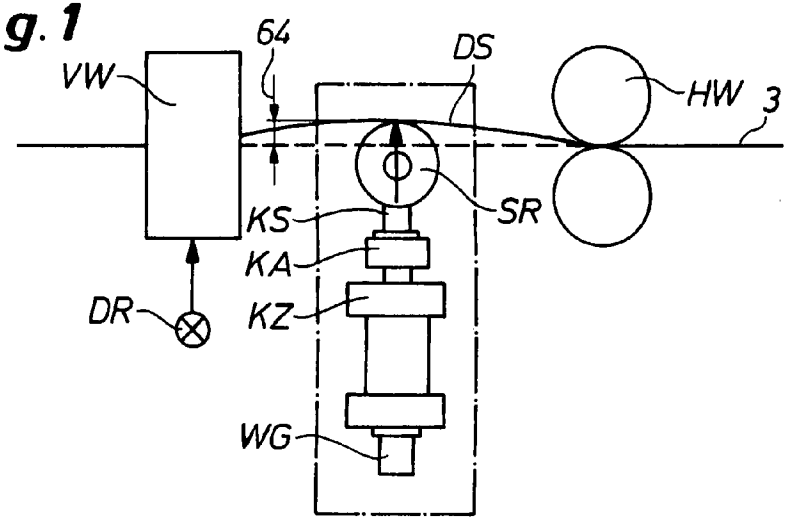
FIG. 1 is a schematic illustration showing a portion of the rolling line in a side view of a detail of an apparatus in accordance with the invention and representing a portion thereof applying traction to the wire rod mill stand.

The apparatus for measuring the tension or traction on the wire rod strand and for applying traction thereto as shown in FIG. 1 comprises between a vertical roll stand VW and a horizontal roll stand HW, forming a pair of such stands with speed control as represented at DR to vary the traction applied to the strand 3 engaged in the nips of the pairs of rolls of each stand and forming the pair of stands referred to previously and hereinafter.

Between those stands, a piston and cylinder unit KZ is arranged, the piston KS of which carries a tension roller Sr which bears upon the wire rod strand 3 between the nips of the vertical and horizontal rolls to impart a deflection DS to the strand from below.

The piston-and-cylinder arrangement KZ can be a hydraulic or pneumatic control cylinder and is connected with a force backup or sensor KA and a position sensor WG. With this arrangement, the wire rod strand 3 between the roll pairs VW and HW can be pre-stressed to a targeted extent and the height of the deflection DS can be determined and measured. The entire unit for measuring the tractive force or tension, controlling the tractive force and controlling the cross section formed by the measurement and control cylinder unit has been indicated in simplified form by a dot dash box.

Figure 2:
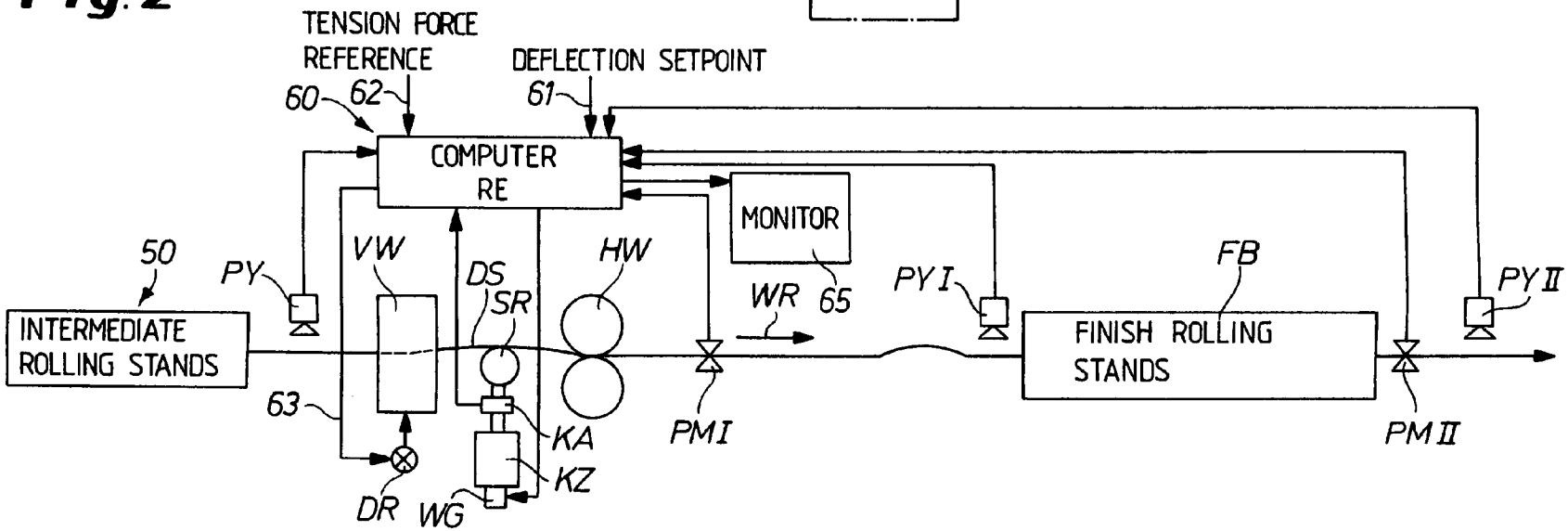
FIG. 2 is a similar side view of a portion of a wire rod rolling mill line showing the traction application upstream of the finishing rolling unit.
Figure 6:
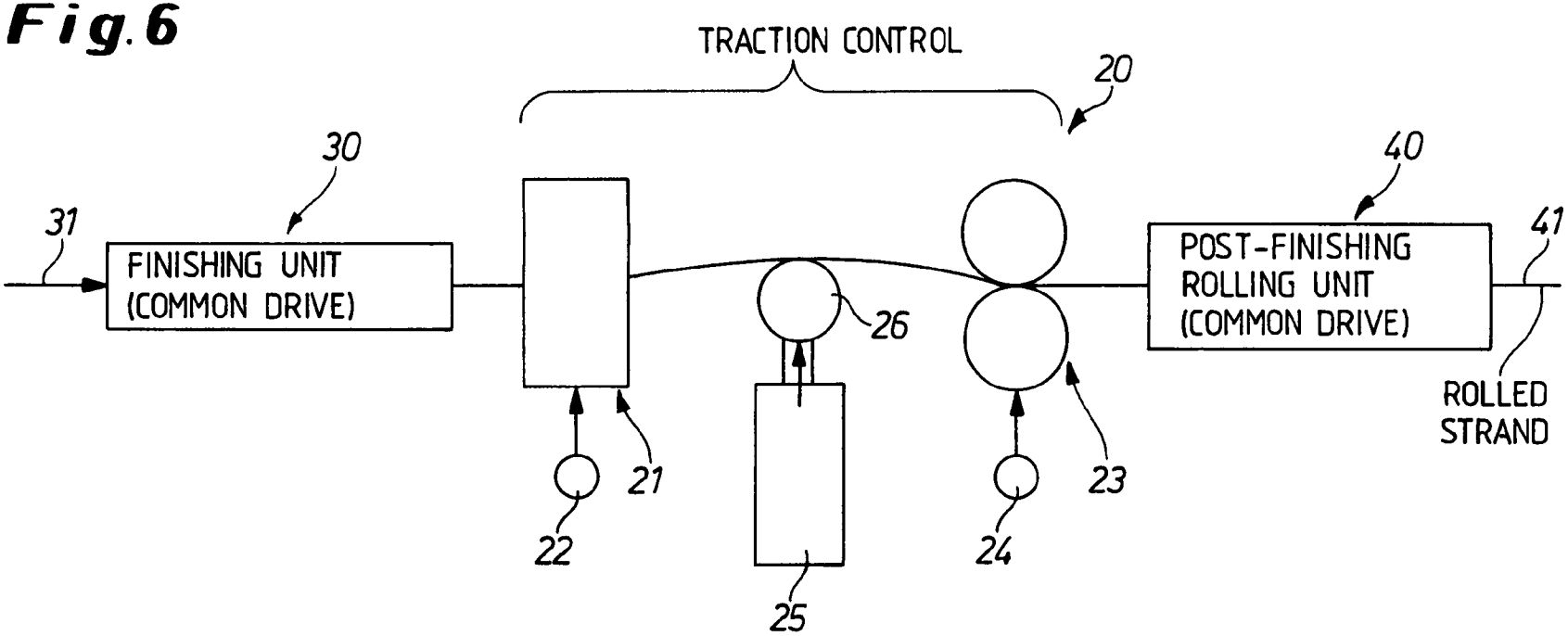
FIG. 6 is a diagram of an alternative system in which the traction control unit, e.g. of FIG. 1 is applied between the finishing unit with its common drive group and a post finishing rolling unit or stand with its common drive group.

FIG. 6 shows that the traction control unit 20 formed by the vertical roll stand 21 and its variable speed drive 22 and the horizontal roll stand 23 and its variable speed drive 24 and the measurement and control cylinder unit 25 with the deflection roller 26 can be located between the finishing unit 30 of the mill line with its common drive and a post finishing rolling unit 40 with its common drive. The wire rod strand after multiple pass rolling in initial and intermediate stages enters the finishing unit at 31 and the finished rolled strand emerges from the post finishing unit 40 at 41 with its cross section having close tolerances and uniformity over the entire length in spite of the fact that the last control of tension within the line is upstream of the last common drive unit which, in the embodiment of FIG. 6 is the post finishing rolling unit. In the embodiment of FIG. 2, the last common drive unit is the finish rolling unit FB. The last traction control is therefore provided upstream of the finishing block or unit FB in the rolling direction WR.

In the embodiment of FIG. 2 the strand arrives from the intermediate rolling stands 50 of the rolling line. The traction control and measuring unit of FIG. 1 is thus provided upstream of the finish rolling stands and downstream of the finish rolling unit FB but upstream of the traction control unit, a profile measuring device PM1 is provided while a further profile measuring device PM2 is provided downstream of the finishing unit FB. In addition, in the rolling direction WR upstream of the finishing unit a respective pyrometer PYI is provided to measure the strand temperature while another pyrometer PYII is provided downstream of the finishing unit.

For the processes of the invention, whereby the cross sectional tolerances of the output strand are reduced by controlling the variation of the entry cross section of the strand into the finishing unit FB by regulating the tractive force on the wire rod, the device of FIG. 1 is used. This operates as follows:

After the leading end of the wire rod strand enters the unit of FIG. 1, the tension roller Sr is pressed upwardly by the cylinder KZ against the strand to produce a deflection DS therein. The extent of this deflection is a measure of tension in the strand and the magnitude of the tension is continuously detected and fed to a computer and tractive force control unit represented at 60 or RE. The latter can include a memory for the values received by the computer. Since the tractive force applied to the wire rod strand is a function of the tension and deflection of the wire rod by the tension roller Sr, the traction can be controlled with the aid of the position regulation of the tension roller via the position sensor WG. By maintaining a constant traction between the vertical and horizontal roll stands VW and HW, cross sectional defects in the wire rod strand can be eliminated and the strand as fed to the finishing unit FB can have a relatively constant entry cross section so that as a consequence an optimum finished cross section can be produced.

Using the deflection control, a set point deflection is initially established as represented at 61 in FIG. 2 and its magnitude is selected to optimize the cross section, i.e. is a function of the cross section. Using a product dependent deflection, therefore, the ratio between the tractive force and the tension force can be optimized. In order to reach the reference value for the tension force, the speed of the adjustable stand, e.g. the stand VW, is corrected until the tension force, that is the actual tension, reaches the predetermined reference value (shown for example at 62 in FIG. 2). Then the tension force is maintained constant by the speed correction as represented by the arrow 63 in FIG. 2).

Using the speed control for the tension force, the deflection 64 (FIG. 1) can be so controlled that the desired reference value and thus also the tractive force are reached and maintained constant to the greatest possible extent.

In order to operate in an optimum tractive force range, the speed correction can be set for the tractive force controlling stand VW and the speeds of the stands VW and HW need not be altered.

In a further mode of operation, measurements of the cross section of the strand can be used. For that purpose, the profile measuring device PMI is provided in FIG. 2 downstream of the vertical and horizontal roll pairs VW and HW of the arrangement according to FIG. 1 and upstream of the finishing unit FB while another profile measuring unit PMII is located downstream of the finishing unit FB. A precondition for such cross sectional control is, however, the tractive force control as previously described. When the leading end of the strand passes the horizontal roll stand HW, the tractive force control is activated. The leading end then passes the profile measuring device PMI which continuously measures the rolled product cross section before it ends the finishing unit FB and provides the relevant parameter or parameters, for example, profile width or height, for the computer 60 and can display those parameters or the cross section on a monitor 65 connected to the computer. The cross sectional control utilizes the traction developed between the two stands to optimize the cross section at the outlet side of the last of these stands. The control parameter in this case is not the traction as with traction control in the manner previously described, but the outlet cross section. The traction is then not held constant but varied to maintain a cross section setpoint. The traction variation can be achieved with speed correction at the roll stand VW or by variation of the deflection DS.

For a closed loop control, the profile measurement unit PMII downstream of the finishing unit FB is required. The rolling groove filling downstream of a stand can thus be used as the control parameter for the cross sectional control upstream of the finishing unit FB. The entry cross section thereto can be so varied by the application of a variable traction between the frames VW and HW that downstream of the unit FB the groove filling is optimal and a constant width of the cross section and thus a good ovalness.

Figure 3:
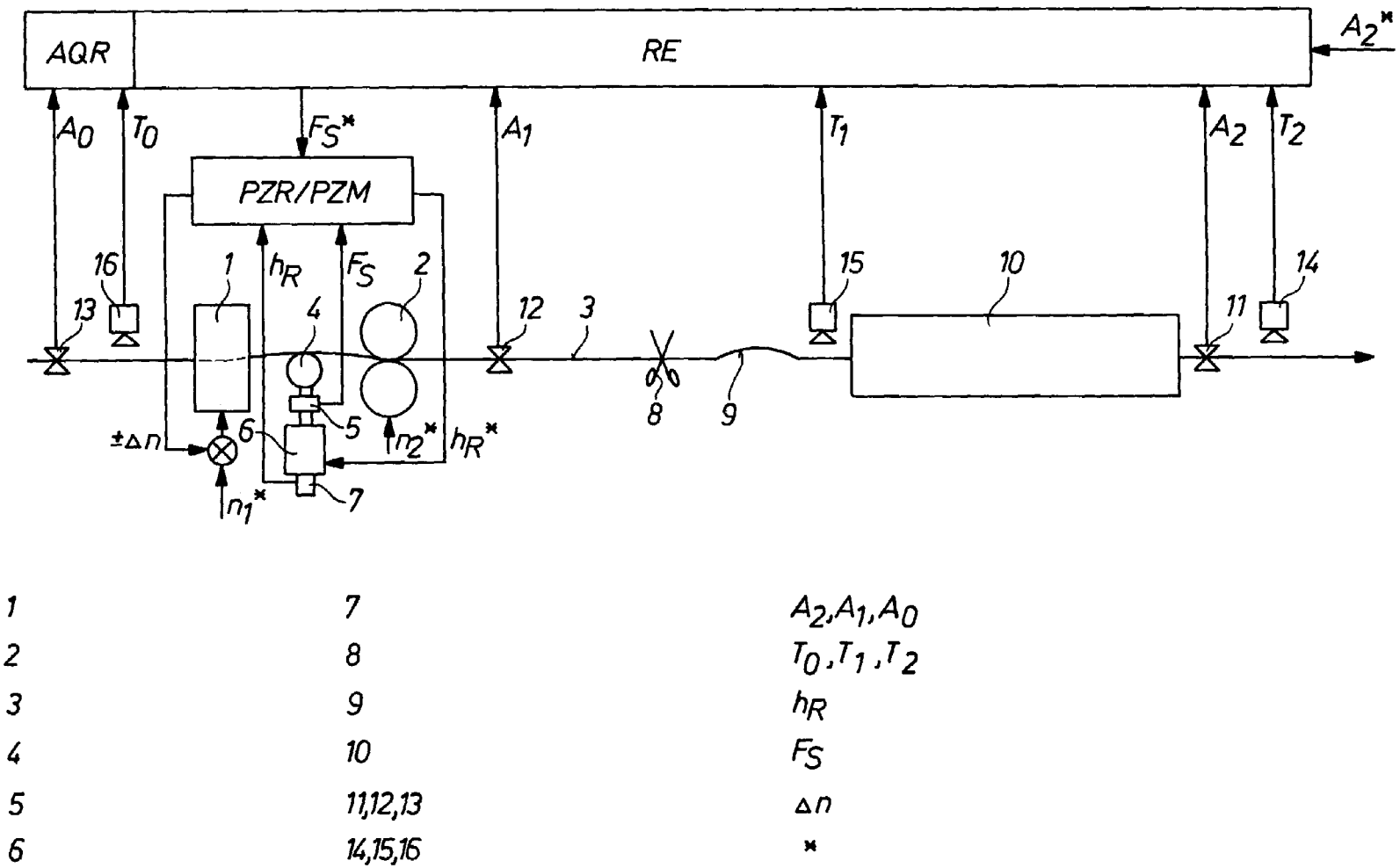
FIG. 3 is a view similar to FIG. 2 of a system operating adaptively with direct control of the cross section.

FIG. 3 shows the system previously described utilizing the direct or forwarded control for the correlation between the cross section $A_0$ of the strand 3 upstream of the tension control unit and the cross section $A_1$ downstream thereof. This system comprises, as has been described, the vertical roll stand 1, the horizontal roll stand 2 and the tension roll 4 between these two stands, deflecting the wire rod strand 3. The tension roll 4 is provided on the piston of cylinder 6 via a force backup 5 which can be of the strain gauge type feeding the tension force $F_S$ to the PZR/PZM unit in which PZR represents position-tension control and PZM represents position-tension measurement. The position cross section control is represented at AQR where AQR is the adaptive control of the cross section, RE representing the computer in this embodiment. The cylinder is also provided with a displacement backup 7 whose output $h_R$ represents the deflection.

The profile measuring system is formed by the cross section measuring units 11 downstream of the last rolling unit with common drive, represented at 10, a cross section measuring unit 12 upstream thereof and a cross section measuring unit 13 upstream of the traction control. Similarly, pyrometers 14, 15 and 16 are provided respectively downstream of the last rolling unit 10, upstream thereof and upstream of the traction control pair of stands. These pyrometers feed respective temperatures $T_0$, $T_1$ and $T_2$ to the computer RE and inputs $A_0$, $A_1$ and $A_2$ representing the cross sections are supplied to the computer by the profile measuring sensors 13, 12 and 11 respectively. An asterisk (*) represents a set point value of the respective parameter. $F_6$ represents the output of the computer to the position-traction measurement and control unit. At 8, a sheer can be provided for cutting the strand into lengths and for diverting defective portions of the strand while a loop representing storage of the strand can be provided upstream of the final block.

Figure 4:
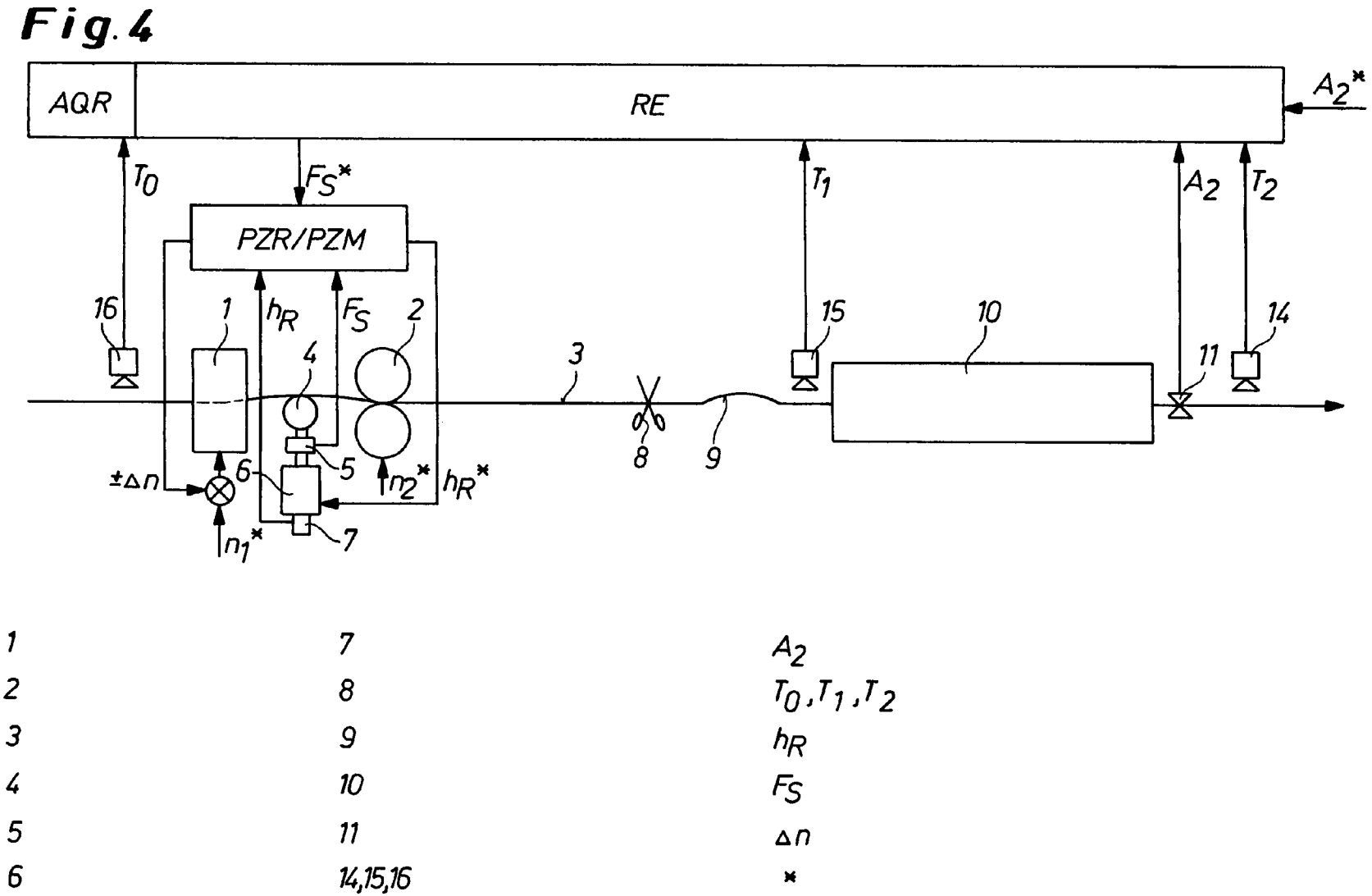
FIG. 4 is a schematic illustration generally similar to FIGS. 2 and 3 of an arrangement for adaptive cross sectional regulation with slow backward regulation as mentioned earlier.

FIG. 4 shows an equivalent system for slow backward regulation and similarly numbered or identified components in this figure are equivalent to those previously identified as to FIG. 3.

Figure 5:
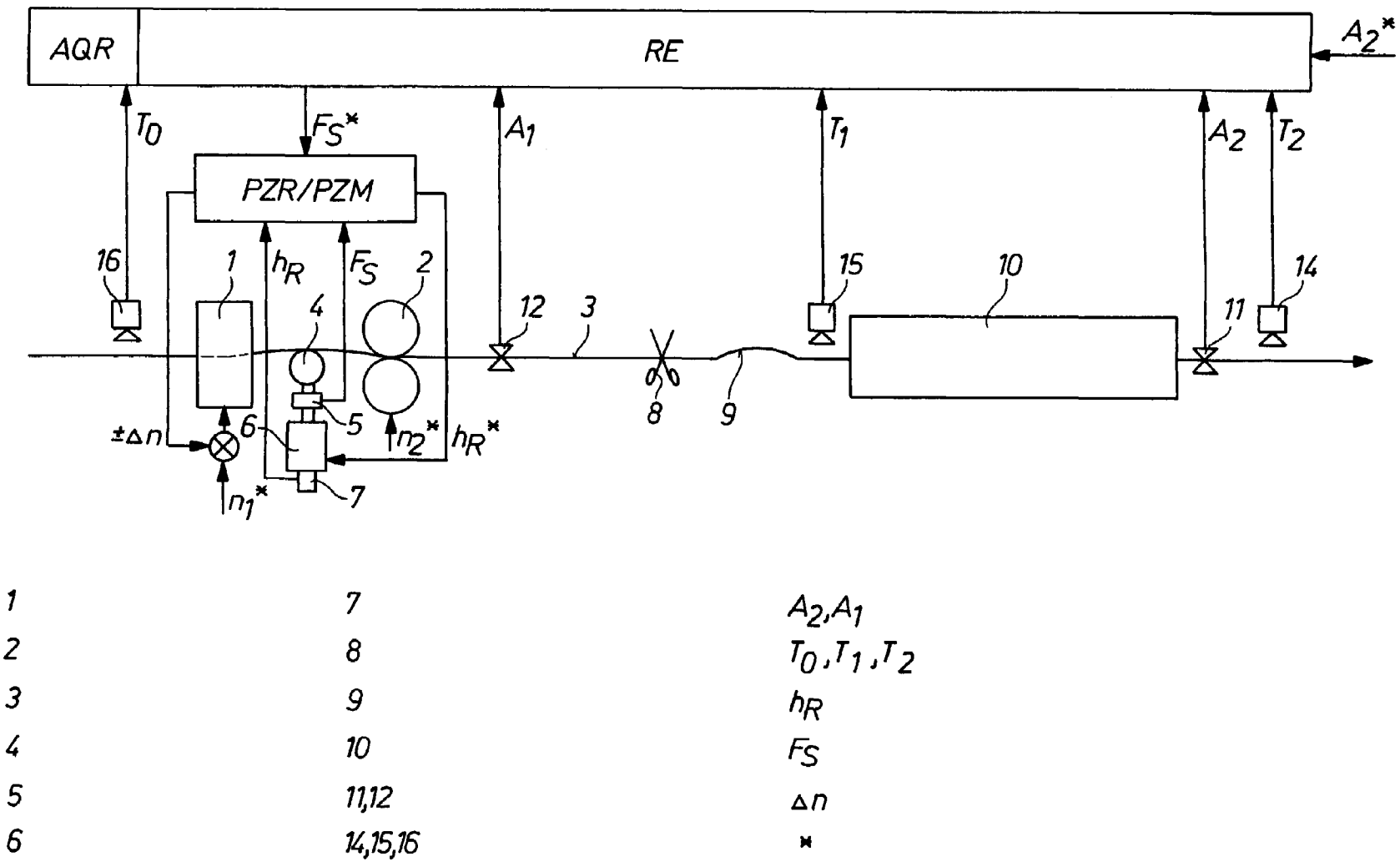
FIG. 5 is a view similar to FIG. 4 but of a system for adaptive cross sectional regulation by rapid backward regulation.

FIG. 5 shows the system for fast backward regulation.

We claim:

1. A wire rod mill for rolling a rolled wire rod strand, the mill comprising:

a series of mill stands for rolling a wire rod strand and including an intermediate unit of rolling stands;

a finish rolling unit downstream in a travel direction of the strand of said intermediate unit and including at least one finishing mill stand, the finish rolling unit including at least one horizontal-roll mill stand and at least one vertical-roll mill stand arranged in succession along a path of said strand with the rolls of at least one of the horizontal-roll and vertical-roll stands being individually adjustable or individually drivable; and means for altering the cross section of the wire rod strand during the rolling by controlled application of traction to the strand by applying traction for cross section alteration to the strand immediately upstream of the finish rolling unit and regulating the applied traction so that the wire rod strand emerging from the finish rolling unit is of constant uniform cross section.

2. The wire rod mill defined in claim 1, further comprising a tension roll between the series of mill stands and pressed against said strand to deflect said strand, said tension roll being provided with a force sensor and a position sensor.

3. The wire rod mill defined in claim 1, further comprising means including a cross section measurement device along a path of said strand upstream of the finish rolling unit for controlling the finish rolling unit for altering the cross section of the strand.

4. The wire rod mill defined in claim 3, further comprising respective strand-profile measuring devices are provided along the path of said strand upstream and downstream of the series of mill stands for controlling said means for altering the cross section of the strand.

5. The wire rod mill defined in claim 4, further comprising means including a strand-profile measuring device downstream of said finish rolling unit for controlling the finish rolling unit for altering the cross section of said strand.

6. The wire rod mill defined in claim 1 wherein said means for altering the cross section of said strand includes pyrometers upstream and downstream of the series of mill stands for measuring the temperature of said strand.

7. The wire rod mill defined in claim 1 wherein said means for altering the cross section of said strand includes a tension roll pressed against said strand to deflect said strand, said tension roll being provided with a force sensor and a position sensor.

* * * * *